US005988097A

United States Patent [19]

Karney et al.

[11] Patent Number: 5,988,097

[45] Date of Patent: Nov. 23, 1999

[54] WATERCRAFT STABILIZED BY CONTROLLED HYDROFOIL ELEVATION

[76] Inventors: Steven Karney, 7322 NW. 58th Way, Parkland, Fla. 33068; Edward Frieling, 5670 Willow Creek Ct., Delray Beach, Fla. 33484

[21] Appl. No.: 09/197,987

[22] Filed: Nov. 23, 1998

Related U.S. Application Data

[63] Continuation-in-part of application No. 08/646,849, May 8, 1996, Pat. No. 5,839,386.

[51] Int. Cl.[6] ..... B63B 1/20

[52] U.S. Cl. ..... 114/283

[58] Field of Search ..... 114/61.15, 283, 114/274, 275, 278, 280, 282, 61.1, 61.12, 61.13

[56] References Cited

U.S. PATENT DOCUMENTS

| | | | |
|---|---|---|---|
| 3,156,209 | 11/1964 | Ask | 114/275 |
| 3,998,176 | 12/1976 | Stout et al. | 114/283 |
| 5,107,783 | 4/1992 | Magazzu | 114/123 |
| 5,787,832 | 8/1998 | Spinka | 114/122 |

FOREIGN PATENT DOCUMENTS

| | | | |
|---|---|---|---|
| 404133893 | 5/1992 | Japan | 114/283 |

*Primary Examiner*—Ed Swinehart
*Attorney, Agent, or Firm*—Alvin S. Blum

[57] ABSTRACT

A watercraft has starboard and port hydrofoils or hydroskis that are supported by individually powered fore and aft supports for adjustable retraction and extension below the hull under control of a computer using signals from water speed, turn angle, roll angle and pitch angle sensors to maintain stability of operation, especially on high speed turns where the hull may be banked into a turn by positioning the ski on the inside of the turn lower than the other ski.

11 Claims, 2 Drawing Sheets

WATERCRAFT STABILIZED BY CONTROLLED HYDROFOIL ELEVATION

This invention is a continuation in part of copending U.S. patent application Ser. No. 08/646,849 filed May 8, 1996, now U.S. Pat. No. 5,839,386.

FIELD OF THE INVENTION

This invention relates to watercraft and more particularly to means for stabilizing watercraft at high speed by controlled elevation of hydroskis or extending beneath the hull.

BACKGROUND OF THE INVENTION

High speed boats that rise up to plane with the hull at least partially out of the water are vulnerable to rolling over and capsizing, especially in a sharp turn. Boats with hydrofoils or pontoons beneath the hull are capable of very high speeds. However, because of their high center of gravity, they are even more vulnerable to rolling over at high speeds, and/or in rough seas. Some of these watercraft are limited to only 5 degree turns at speeds of 125 miles per hour. It would be desirable to have a mechanism associated with hydrofoil elevation and retraction that would further stabilize the vessel at high speeds.

SUMMARY OF THE INVENTION

It is accordingly an object of the invention to provide a stabilizing mechanism to a high speed watercraft associated with hydrofoils that are individually vertically retractable and extensable to overcome rolling and pitching forces, especially those forces associated with high speed turns. The hydrofoils may be retracted or extended under computer control in response to signals from one or more sensors related to water speed, propeller rotation, roll angle, and rudder angle. Each hydroskis or may be supported by separate fore and after individually powered supports. A pitch angle sensor may also provide signals to the computer control for separate fore and aft hydrofoil support adjustments to modify the pitch angle or attitude of the vessel. The pitch adjustment may also be used for most efficient attitude adjustment during operation independent of the pitch angle sensor.

These and other objects, advantages and features of the invention will become more apparent when the detailed description is studied in conjunction with the drawings in which like reference characters designate like elements in the various drawing figures.

DETAILED DESCRIPTION OF PREFERRED EMBODIMENTS

Figure 1:
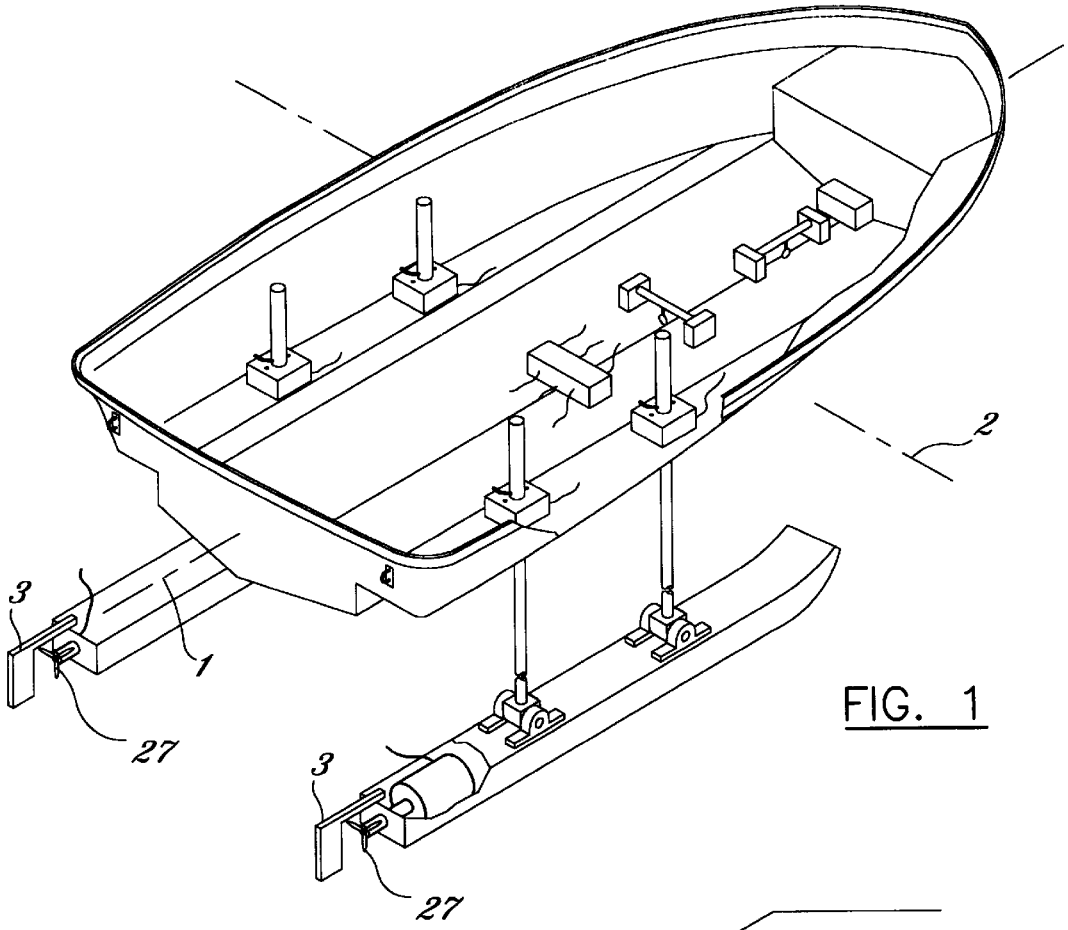
FIG. 1 is a perspective diagrammatic view, partially broken away, of a watercraft of the invention.
Figure 2:
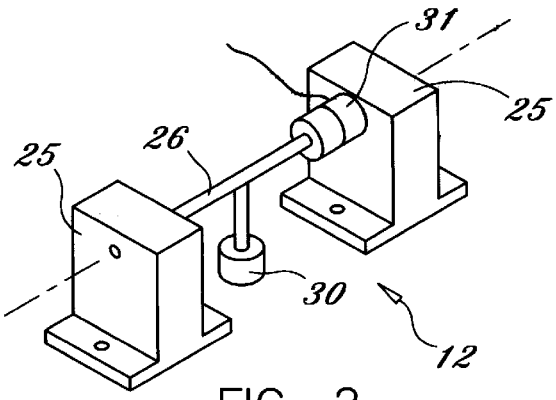
FIG. 2 is a perspective view of a roll angle sensor.
Figure 3:
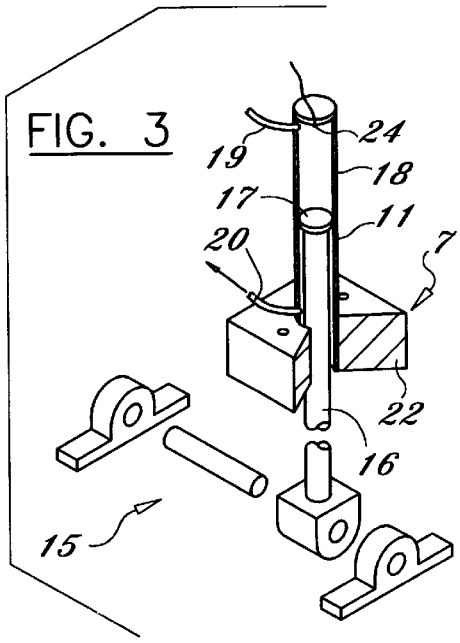
FIG. 3 is a perspective exploded view, partially broken away, of a hydraulically powered hydroski support.

Referring now first to FIGS. 1–3, a high speed watercraft 29 of the invention is powered by internal combustion engine/electric generator 14 which provides electric power to electric propulsion motors 28 which drive propellers 27. The motors 28 are within hydroskis 5 and 6 that adjustably retract and extend below hull 29 to stabilize the hull and enhance high speed operation. Starboard ski 5 is connected to the hull by fore ski support 7 and aft support 8. Port hydrofoil 6 is connected to the hull by supports 9 and 10. Each support comprises a connector 15 that bolts to the pontoon and pivotally connects to piston shaft 16. Each piston head 17 is driven up or down within hydraulic cylinder 18 by hydraulic fluid through hoses 19,20 from a hydraulic pump and control 21 driven by engine 14. Hose lines and electric lines interconnecting various elements in the drawings have been omitted for clarity. The ski supports may be powered by other means such as rack and pinion. Hydraulic control maintains the degree of extension of each of the skis separately. It can also, by adjusting fore and aft supports separately, adjust the attitude of the foil relative to the hull for optimal performance. The hydraulic control is in turn controlled by a computer 23. The degree of extension of each support may be sensed by a proximity sensor 24 within the piston. This may be, for example, but not limited to, an ultrasonic sensor.

The computer 23 also receives signals for additional sensors to be used by the computer in determining when and how to extend or retract the ski supports for optimal performance. A turning mechanism such as a rudder 3 includes a rotary position indicator to provide a rudder angle signal. A pendulum type roll angle sensor 12 is best seen in FIG. 2. Two supports 25 pivotally support a shaft 26 with a pendulum weight 30. A rotary position indicator 31 connected between support 25 and shaft 26 provides a roll angle signal to computer 23. A dashpot 32 may damp out short term movements. The roll sensor 12 is mounted in the hull with the shaft parallel to the roll axis 1. A similarly constructed pitch angle sensor 13 is mounted with its shaft parallel to the pitch axis 2 to provide a pitch angle signal to the computer 23. A tachometer 33 at each propeller shaft provide a signal to the computer of each propeller rotation rate. A water speed sensor 4 provides a signal to the computer of the speed of the hull over the water. A manual control of ski supports is also provided to the computer. The propellers, extending from the skis, are always at the water level, even when the hull is completely above water where it may run in a heavy sea at considerably higher speeds as is well known in the art. The propeller motors may alternatively be hydraulic motors. Water intakes 34 for cooling engine 14 and also, optionally, for cooling drive motors 28 may also be provided at the hydrofoils to provide cooling water at any hydrofoil or hydroski elevation. Hydraulic and cooling hoses are not shown.

Figure 4:
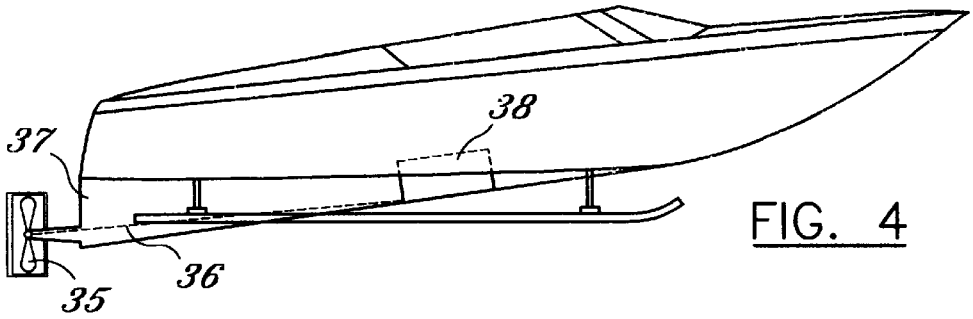
FIG. 4 is a side elevation view of another watercraft embodiment of the invention.
Figure 5:
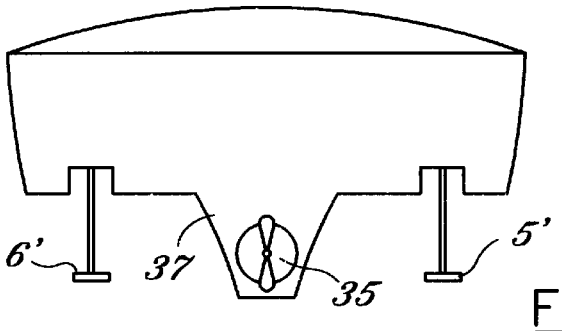
FIG. 5 is a rear elevation view of the watercraft shown in FIG. 4.

Referring now to FIGS. 4 and 5, another embodiment of the invention is shown in which the propeller 35 is driven by a shaft 36 within a keel 37 extending downward from the main hull and connected to engine 38. Skis 5',6' recess into the hull when retracted. In a sharp turn at high speed, the hull might roll enough to the outside of the turn to lift the propeller out of the water and to cause the hull to slide sideways. Extending the ski on the outside of the turn more than the ski on the inside of the turn, creates a banking condition, reducing the roll tendency and the sideways motion. In this configuration, the amount of elevation of the hull is limited by the fixed propeller position. It has advantages in direct propeller drive and fixed cooling water pickup.

Figure 6:
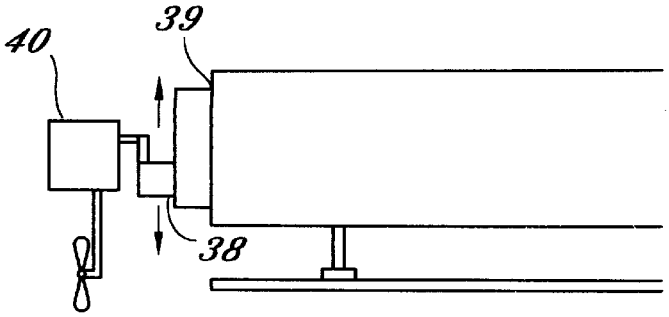
FIG. 6 is a partial side elevation view of another embodiment of the invention.

Referring now to FIG. 6, another embodiment of the invention is shown in which propulsion is provided by one or more outboard motors 37 mounted on a vertically adjustable motor mount 38 that is bolted to the transom 39. The vertical movement of mount 38 may be by a helical screw or hydraulic piston, for example. The elevation of the outboard propulsion means is controlled by the computer to maintain the propeller in optimum position as the ski elevation changes. The embodiments of FIGS. 1 and 6 enable the hull to travel in very shallow waters as the propeller elevation may be easily adjusted.

Computer Control of Ski Extension

The vessel at high speeds may perform like a catamaran with the skis extended to lift the hull at least partially above the water level. Roll and pitch may be at least partially corrected by the relative degree of extension of the ski supports. The computer controls the degree of extension of each of the ski supports using at least one and preferably many of the input signals from the various sensors as required to control roll and pitch and even to adjust in anticipation of rolling and pitching that will come about from the various conditions that are sensed. Control of an element or elements by a computer on the basis of multiple independent variables is well known in the art. Each hull and ski configuration is going to roll or pitch at different rates of turning angle, which may be determined by rudder angle and propeller shaft turning rates; over water speeds; and ski elevation, that will require different rates and amounts of compensating retraction of the ski supports. These requirements may be estimated by computer simulation and further refined by empirical determination in actual hull operation. Additional corrections may have to be made for hull load distribution and wind velocity and direction. These effects may be best determined by the roll and pitch sensors whose signals are also used by the computer. The values of all the parameters are stored in a look up table in the computer. At a particular speed and turning angle and roll and pitch angles, the values are entered into the look up table and corresponding amounts of extension of each of the ski supports is found and applied to the supports to adjust for most stable operation. The initial values in the look up table may be refined by repeated empirical observations under actual use conditions, including interpolation between initial coarse values.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

What is claimed is:

1. A watercraft having a hull with a roll axis extending along the direction of travel and a pitch axis athwartship and transverse to the roll axis, the watercraft comprising:

first and second elongate, vertically retractable and extensable skis mounted to the underside of the hull and having long axes parallel to the roll axis and on either side thereof by separate fore and aft ski supports;

power means operatively connected to the ski supports for selectively translationally extending or retracting each ski support individually;

roll sensor means mounted in the hull and having a rotational axis parallel to the roll axis for sensing roll angle and generating roll signals therefrom;

a turning mechanism connected to the hull for turning the forward motion of the hull through a turning angle; and control means interconnecting the power means and the roll sensor means for altering the relative extension of the two skis to reduce the roll tendency of the hull in response to the roll signal.

2. The watercraft according to claim 1 further comprising: turn sensor means operatively connected to the burning mechanism for generating turn signals related to the turning angle; and the control means further interconnected to the turn sensor means for altering the relative extension of the two skis to reduce the roll tendency of the hull in response to at least one of the roll signal and the turn signal.

3. The watercraft according to claim 2, further comprising:

pitch sensor means mounted in the hull and having a rotational axis parallel to the pitch axis for sensing pitch angle and generating signals related to the pitch angle;

said separate ski supports on either side of the roll axis comprising separately extensible and retractable fore and aft supports for said each ski separately adjustable by the power means; and the control means further interconnected to the pitch sensor means for altering the attitude of the hull by selectively adjusting the fore and aft supports in response to the pitch signals.

4. The watercraft according to claim 3 further comprising velocity sensing means connected to the hull for generating velocity signals related to the velocity of the hull, and the control means further interconnected to the velocity sensing means to selectively modify the ski elevation and retraction in response to the velocity signals.

5. The watercraft according to claim 2 further comprising velocity sensing means connected to the hull for generating velocity signals related to the velocity of the hull, and the control means further interconnected to the velocity sensing means to selectively modify the ski elevation and retraction in response to the velocity signals.

6. The watercraft according to claim 1 further comprising velocity sensing means connected to the hull for generating velocity signals related to the velocity of the hull, and the control means further interconnected to the velocity sensing means to selectively modify the ski elevation and retraction in response to the velocity signals.

7. The watercraft according to claim 1 further comprising a propulsion means attached to each ski for propelling the hull that extends and retracts along with the ski.

8. In a watercraft having a hull with a roll axis extending generally along the direction of travel, a pitch axis athwartship and transverse to the roll axis, a turning mechanism, and a velocity sensing means for providing a velocity signal representing velocity over water, a stabilizing apparatus comprising:

first and second elongate, vertically retractable and extensable skis mounted by separate fore and aft hydrofoil supports to the hull and having long axes parallel to the roll axis and on either side thereof;

power means operatively connected to the ski supports for selectively translationally retracting or extending each ski support individually below the hull;

roll sensor means connected to the hull and having a rotational axis parallel to the roll axis for sensing roll angle and generating a roll signal therefrom;

turn sensor means operatively connected to the turning mechanism and generating a turn angle signal therefrom; and control means connected for receiving roll signals, turn angle signals, and velocity signals and also connected to the power means for individually altering the extension of the two skis to reduce roll tendency in response to at least one of the signals.

9. The apparatus according to claim 8 further comprising:

pitch sensor means mounted in the hull and having a rotational axis parallel to the pitch axis for sensing pitch angle and generating signals related to the pitch angle;

said separate ski supports on either side of the roll axis comprising separately extensible and retractable fore and aft supports for said each ski separately adjustable by the power means; and the control means further interconnected to the pitch sensor means for altering the attitude of the hull by selectively adjusting the fore and aft supports in response to the pitch signals.

10. The apparatus according to claim 9 further comprising a propulsion means attached to each ski for propelling the hull that retracts and extends along with the ski.

11. The apparatus according to claim 10 further comprising a propulsion means attached to each ski for propelling the hull that retracts and extends along with the ski.

* * * * *